US006881383B1

(12) United States Patent
Tschritter et al.

(10) Patent No.: US 6,881,383 B1
(45) Date of Patent: Apr. 19, 2005

(54) EXPLOSIVE DESTRUCTION SYSTEM FOR DISPOSAL OF CHEMICAL MUNITIONS

(75) Inventors: Kenneth L. Tschritter, Livermore, CA (US); Brent L. Haroldsen, Manteca, CA (US); Timothy J. Shepodd, Livermore, CA (US); Jerome H. Stofleth, Albuquerque, NM (US); Raymond A. DiBerardo, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 791 days.

(21) Appl. No.: 09/817,484

(22) Filed: Mar. 26, 2001

Related U.S. Application Data

(60) Provisional application No. 60/192,967, filed on Mar. 29, 2000.

(51) Int. Cl.[7] ..... B32B 23/02

(52) U.S. Cl. ..... 422/165; 422/163; 588/202

(58) Field of Search ..... 422/165, 163; 588/202, 203; 110/237, 346; 206/521, 591

(56) References Cited

U.S. PATENT DOCUMENTS 3,916,805 A * 11/1975 Kalfadelis et al. ..... 110/345
4,027,601 A 6/1977 Hickerson
4,055,247 A 10/1977 Benedick et al.
4,081,982 A 4/1978 Fedorovich et al.
4,478,126 A 10/1984 Holmlund et al.
4,478,350 A 10/1984 Ohlsson
4,621,559 A 11/1986 Ohlson
4,632,041 A 12/1986 Ohlson
5,582,119 A * 12/1996 Barkdoll ..... 110/346
5,613,453 A 3/1997 Donovan
5,884,569 A 3/1999 Donovan

* cited by examiner

*Primary Examiner*—M. Alexandra Elve
(74) *Attorney, Agent, or Firm*—Ulysses John Biffoni

(57) ABSTRACT

An explosive destruction system and method for safely destroying explosively configured chemical munitions. The system comprises a sealable, gas-tight explosive containment vessel, a fragment suppression system positioned in said vessel, and shaped charge means for accessing the interior of the munition when the munition is placed within the vessel and fragment suppression system. Also provided is a means for treatment and neutralization of the munition's chemical fills, and means for heating and agitating the contents of the vessel. The system is portable, rapidly deployable and provides the capability of explosively destroying and detoxifying chemical munitions within a gas-tight enclosure so that there is no venting of toxic or hazardous chemicals during detonation.

34 Claims, 13 Drawing Sheets

EXPLOSIVE DESTRUCTION SYSTEM FOR DISPOSAL OF CHEMICAL MUNITIONS

CROSS-REFERENCE TO RELATED APPLICATIONS

This application is a nonprovisional continuation of provisional application Ser. No. 60/192,967, filed on Mar. 29, 2000, and claims the benefit thereto.

GOVERNMENT INTEREST

The invention described herein may be manufactured, used and/or licensed by or for the United States Government.

BACKGROUND OF THE INVENTION

1. Field of the Invention

The present invention relates to mobile devices capable of destroying, treating, and/or disposing of munitions. More particularly, the present invention relates to transportable devices capable of treating explosively configured chemical munitions providing the capability of a contained destruction of said munitions. Most particularly, the present invention relates to devices capable of explosively destroying and detoxifying chemical munitions within a gas-tight enclosure, i.e., without venting of any explosion combustion products or toxic chemicals during detonation, and providing for the subsequent neutralization or detoxification of any toxic chemicals present such as industrial chemicals and chemical warfare agents.

2. Description of the Related Art

The United States Department of Defense is required under Public Law 102-484, Section 176, to safely destroy all U.S. non-stockpile chemical warfare material (NSCM). The priority for destroying NSCM has increased because of the Chemical Weapons Convention (CWC) negotiations and the realization that some Chemical Warfare Material (CWM) are in the public domain and others are located close to public areas.

The U.S. Army Program Manager for Non-Stockpile Chemical Material (PMNSCM) has developed a transportable Explosive Destruction System (EDS) to provide the capability of destroying explosively configured munitions unsafe for transport or storage. The mission of the EDS is to destroy explosively configured chemical warfare munitions, contain the blast and fragments created when opening the munition, and treat the chemical fill of the munition, without release to the environment.

Devices for safely handling explosives are well known in the art. For example, Fylling, U.S. Pat. No. 3,820,479, describes a mobile container in which an explosive, such as a time bomb, can be placed after discovery for transport to a suitable location for disarming. In includes a ballistic grille to vent explosion gases in an upwardly direction. Hickerson, U.S. Pat. No. 4,027,601, describes a container for explosive devices that includes inner and outer cylinders to substantially contain detonation fragments and the blast. This device is intended to transport improvised explosive devices (IEDs) or homemade bombs to a safe disposal area. Benedick et al., U.S. Pat. No. 4,055,247, describes an explosive storage container designed to absorb and contain the blast, fragments, and detonation products from an unintentional detonation of the contained explosive or munition. Here again, the device is designed to safely transport and store a munition and includes distinct layers to absorb the explosive energy. All of these devices are intended to provide a safe means for transport and/or storage of an explosive, but none are designed for purposeful detonation in order to destroy the explosive, and none are gas-tight or otherwise designed to treat toxic or hazardous chemical payloads.

Holmlund et al., U.S. Pat. No. 4,478,126 describes a chamber for containing the effects arising from explosions or detonations whether initiated intentionally or unintentionally inside the chamber. The chamber comprises a cylindrically formed mantle with associated sealed ends. Ohlsson, U.S. Pat. No. 4,478,350, describes a spherical container or chamber to protect the surroundings by containing critical stages in the manufacture of explosives, or to store or serve as a bunker for explosives. Ohlson, U.S. Pat. No. 4,621,559, describes a readily replaceable liner to be used in detonation chambers and capable of receiving fragments to mitigate the effects of splinters produced by explosions, and in which only damaged parts of the liner need to be replaced; and Ohlson, U.S. Pat. No. 4,632,041, describes a cylindrical blasting chamber which can contain high pressure and splinters produced by an explosion. The blasting chamber includes a double-wall design such that explosive pressure is distributed fairly evenly between the inner and outer walls. However, these devices are not intended to be used for the safe detonation and chemical treatment of explosively configured chemical warfare munitions.

Donovan, in U.S. Pat. Nos. 5,613,453 and 5,884,569, describes methods and an apparatus for containing and suppressing explosive detonations, whether for the explosive working of metals or for the disposal of unwanted explosive munitions. Said apparatus includes a linear array of vent pipes to vent the explosions's gaseous combustion products for subsequent treatment in a scrubber. This apparatus includes a double-walled steel explosion chamber anchored to a concrete foundation, and double-walled access and vent doors. Energy absorbing means such as water-filled bags and conventional chain blast mats are also employed. This device is not intended to be readily mobile, is not equipped for chemical neutralization, nor is it gas-tight so that it can safely contain toxic chemical warfare agents and byproducts.

Explosive chambers have also been developed for controlling and suppressing the detonation of explosives used for industrial applications such as surface hardening of manganese steel rail, welding of metallic components, and compression molding of components from powders. Most of these applications permit the release of the explosion combustion products into the atmosphere. See, for example, U.S. Pat. Nos. 5,419,862 and 4,100,783 issued to Hampel and Gambarov, respectively. Dribas U.S. Pat. No. 4,085,883 and Minin U.S. Pat. No. 4,081,982 disclose spherical containment vessels for explosive working of metals, the latter also including an internal liquid spray for neutralizing toxic byproducts of the explosion. Here again, these devices are intended to explosively work or harden a workpiece, are not intended to access the interior of the workpiece or otherwise destroy it, and are not gas-tight or otherwise suitable for disposal of chemical warfare munitions.

In view of the foregoing, it is therefore highly desirable to provide an apparatus which can be used to dispose of chemical warfare munitions by explosively accessing the interior of said munition within a gas-tight vessel so that all detonation products including any highly toxic chemical warfare agents are contained in a gas-tight manner, and subsequently treating the remains of the munition and the contained detonation products with means to neutralize and detoxify any remaining chemical warfare agent within the gas-tight vessel.

SUMMARY OF THE INVENTION

Accordingly, it is an object of the present invention to provide the apparatus for safely destroying explosively configured chemical munitions, said apparatus comprising a sealable gas-tight explosive containment vessel, a fragment suppression system contained within said vessel, and means for explosively accessing the interior of said munition when it is placed within the fragment suppression system.

It is another object of the present invention to provide an explosive containment vessel that is mobile and can be sized in various embodiments capable of containing at least 500 individual detonations of about 1.0 pound of TNT, or up to 500 individual detonations of about 3.5 pounds of TNT.

It is still another object of the present invention to provide a means for neutralizing or detoxifying any toxic chemicals contained within said vessel.

It is yet another object of the present invention to provide a means for heating said containment vessel to facilitate the neutralization of toxic chemicals therein.

Still another object of the present invention is to provide a means for agitating the contents of said containment vessel in order to facilitate the toxic chemical neutralization process.

It is still a further object of the present invention to provide means for sampling both liquid and gas from the interior of said containment vessel in order to verify the neutralization of any toxic chemicals that were contained therein.

Finally, it is another object of the present invention to ensure the apparatus is easily portable so that explosively configured munitions can be treated and disposed of where they are found without having to transport the munition.

The foregoing and other objects and advantages of the present invention will appear from the following detailed description. In the description, reference is made to the accompanying drawings which form a part hereof, and in which there is shown by way of illustration and not limitation, preferred embodiments. Such description does not represent the full extent of the invention, but rather the invention may be employed in different arrangements or configurations according to the breadth of the invention as defined in the appended claims.

DETAILED DESCRIPTION OF THE PREFERRED EMBODIMENT

Figure 1:
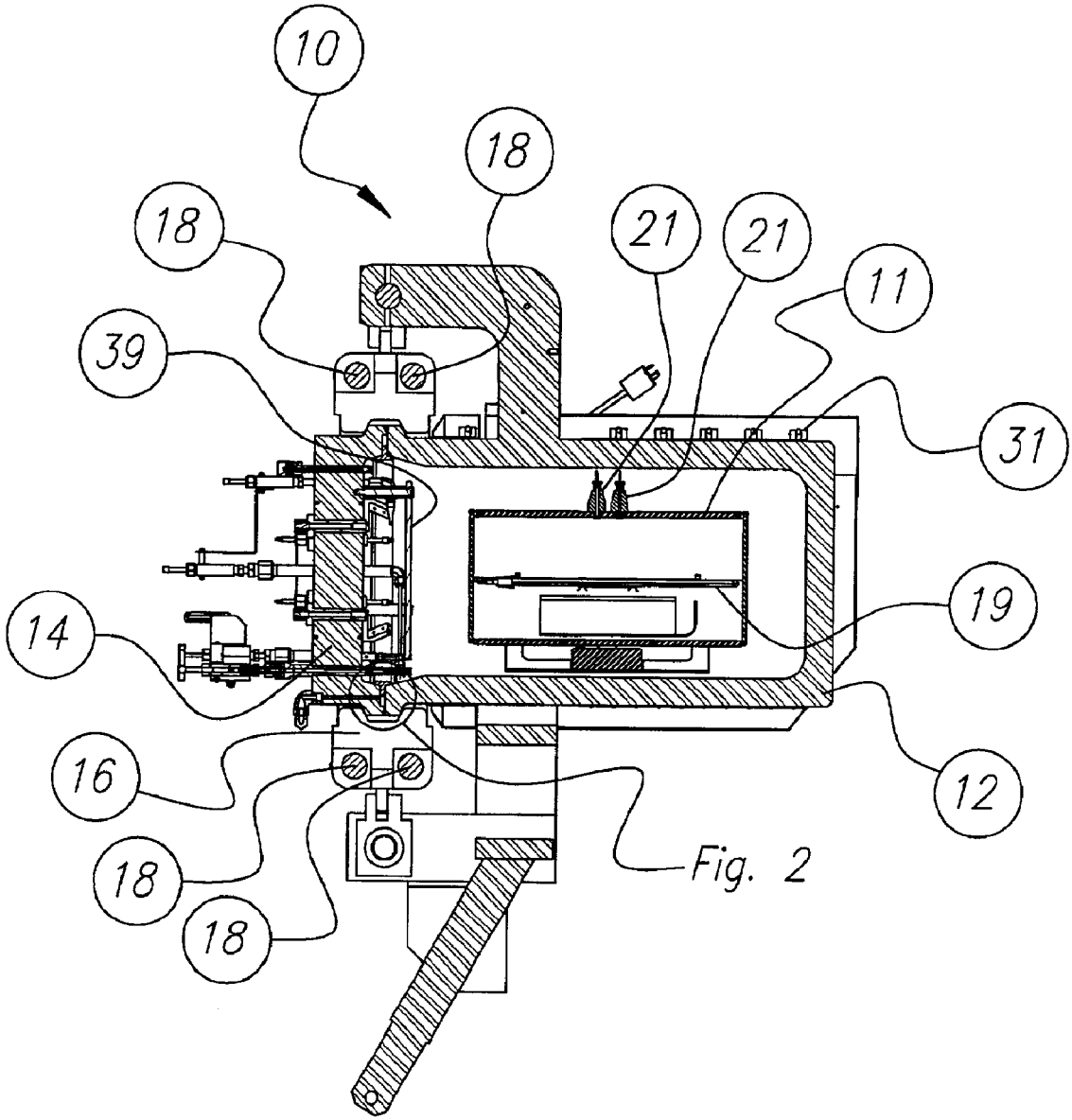
FIG. 1 provides a longitudinal cross-sectional view of the explosive destruction system of the present invention.

Referring now to the drawings, like reference numerals represent identical or corresponding parts throughout the several views.

Figure 2:
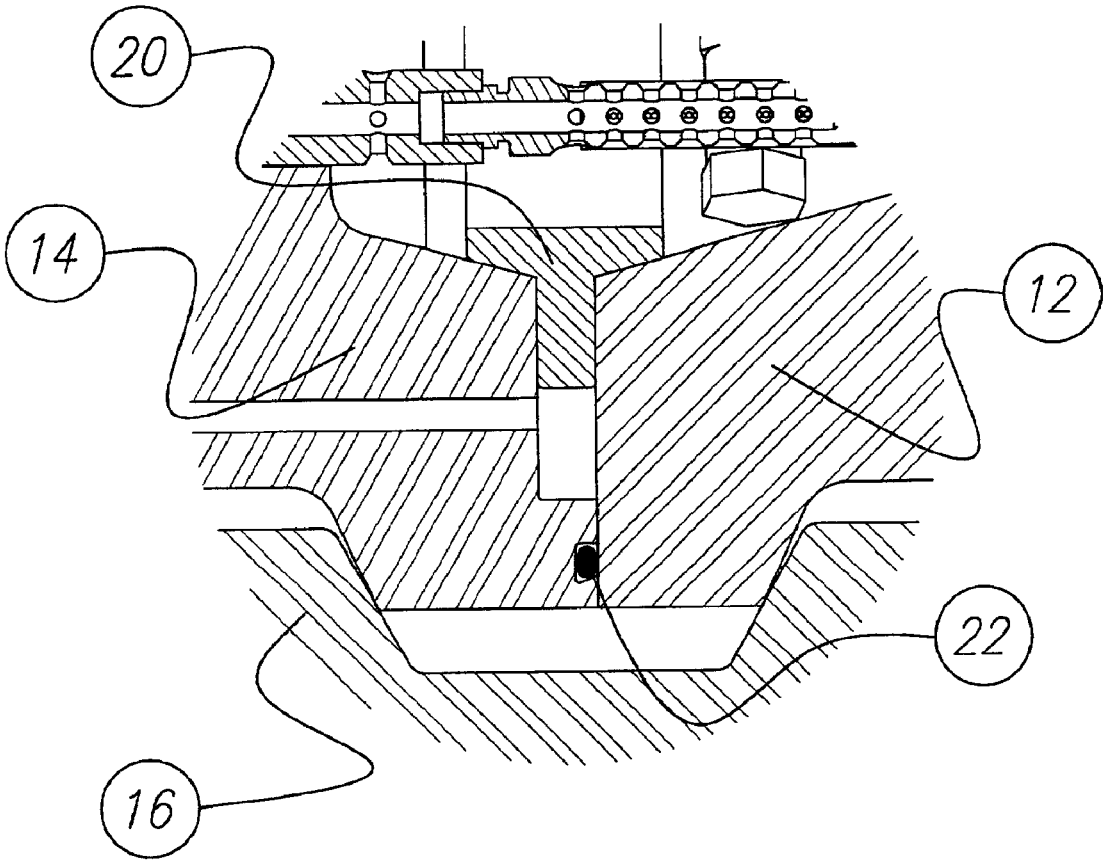
FIG. 2 shows a detailed cross-sectional view of the all-metal seal of the present invention as identified on FIG. 1.
Figure 3:
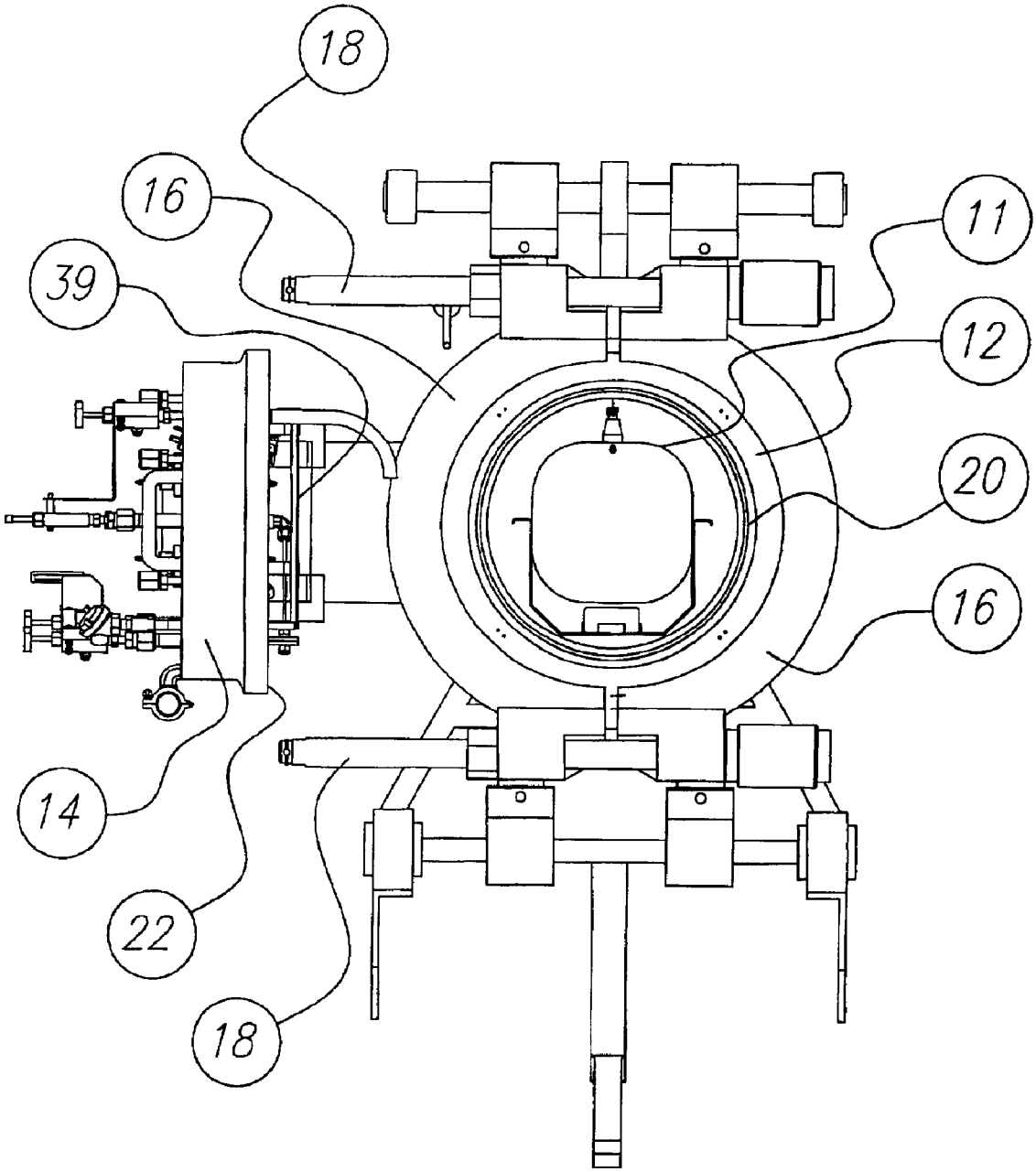
FIG. 3 shows an end view of the system with an open vessel door.

Turning now to FIG. 1, a longitudinal sectional view of the explosive destructive system 10 is shown. The system comprises a cylindrical containment vessel 12 having a hinged sealable door 14. In a preferred embodiment of the invention, both vessel 12 and door 14 are fabricated from 316 stainless steel forgings. Of course, the size of the vessel 12 will vary according the amount of explosive material the user is required to contain. For example, a vessel 12 designed to contain at least 500 detonations of about 1.0 pound of explosive (TNT equivalent) comprises about a 6.5 cubic foot cylindrical vessel having an inside chamber of 20 inches with 2-inch thick walls. The hinged door 14 is the same diameter as the vessel 12, allowing easy access for inserting munitions and removing debris. In this embodiment, the door 14 is secured with a large, two-piece clamp 16 that is fastened with four threaded rods 18. FIG. 3 shows an end-view of the system 10 with an open vessel door 14, vessel 12, clamp 16 and rods 18. In a preferred embodiment, the vessel door 14 is sealed to the vessel 12 using a Grayloc® all-metal seal 20, shown in detail in FIG. 2, to contain the detonation products and chemical fill. A rubber O-ring 22 provides a mechanism for leak testing of the sealed vessel 12. When properly installed and sealed, the helium leak rate through the metal seal at 50-psi differential pressure is less than $1\times10^{-3}$ mbar-l/sec. Also shown is the door protector plate 39, which shields the interior surface of the vessel door 14 from the blast fragments created during detonation.

Figure 6:
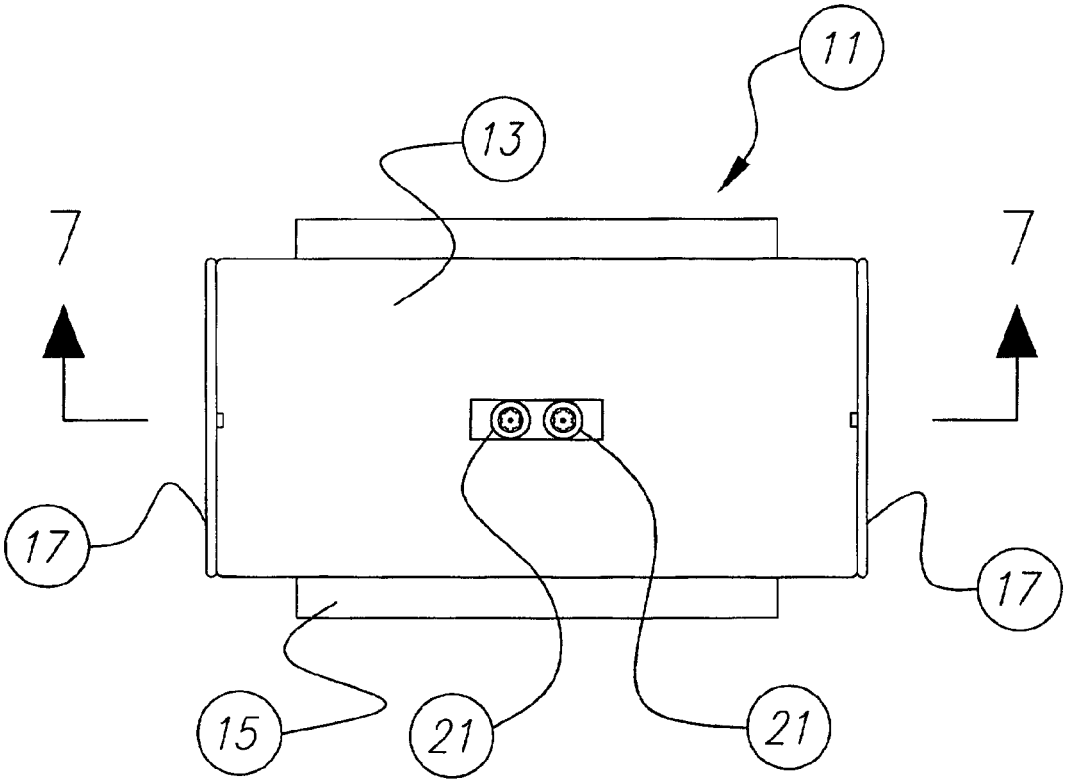
FIG. 6 provides a top view of the fragment suppression system of the present invention.

As shown in FIG. 3, once a munition has been recovered it is placed in the vessel 12 by positioning the munition within a fragment suppression system 11. A top view of the fragment suppression system 11 is provided in FIG. 6 and a cross-section side view is provided in FIG. 7. The fragment suppression system 11 comprises a steel cylinder 13 separated longitudinally into two sections, the lower half including a cradle 15 which supports the suppression system 11 inside the vessel 12. End plates 17 are attached to the cylinder ends to enclose the munition once it is placed in position. Stopper block 41 is positioned below cylinder 13 and is used to stop any penetrating shaped charged jet before reaching the interior wall of vessel 12. The fragment suppression system 11 is necessary to mitigate the effects of high-velocity fragments that could damage the interior of the vessel 12 during operations. In addition, door protector plate 39 provides additional protection to the electrical feedthroughs 24 and the spray nozzles 26 and drains 28 located on the interior surface of the door 14.

Figure 5:
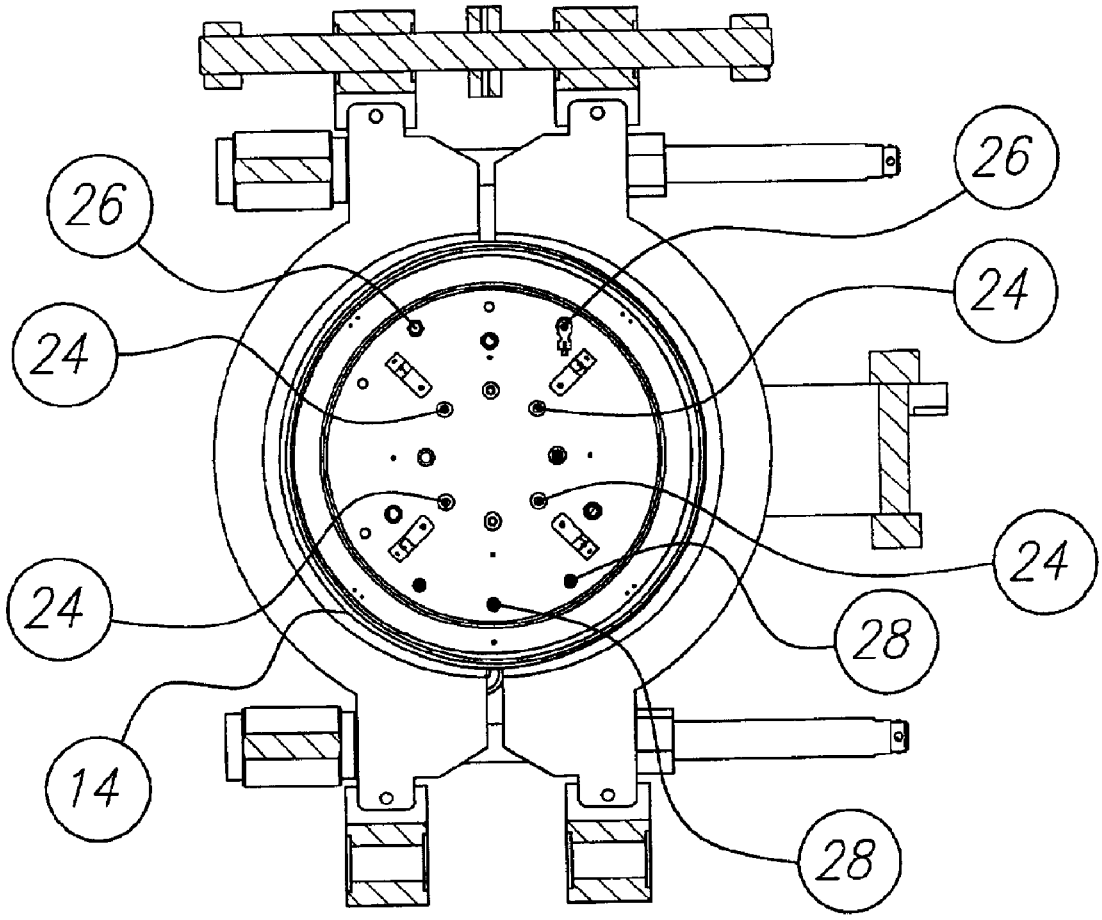
FIG. 5 shows a view of the inside of the system's door including spray nozzles and drains taken along line 5—5 of FIG. 4.
Figure 7:
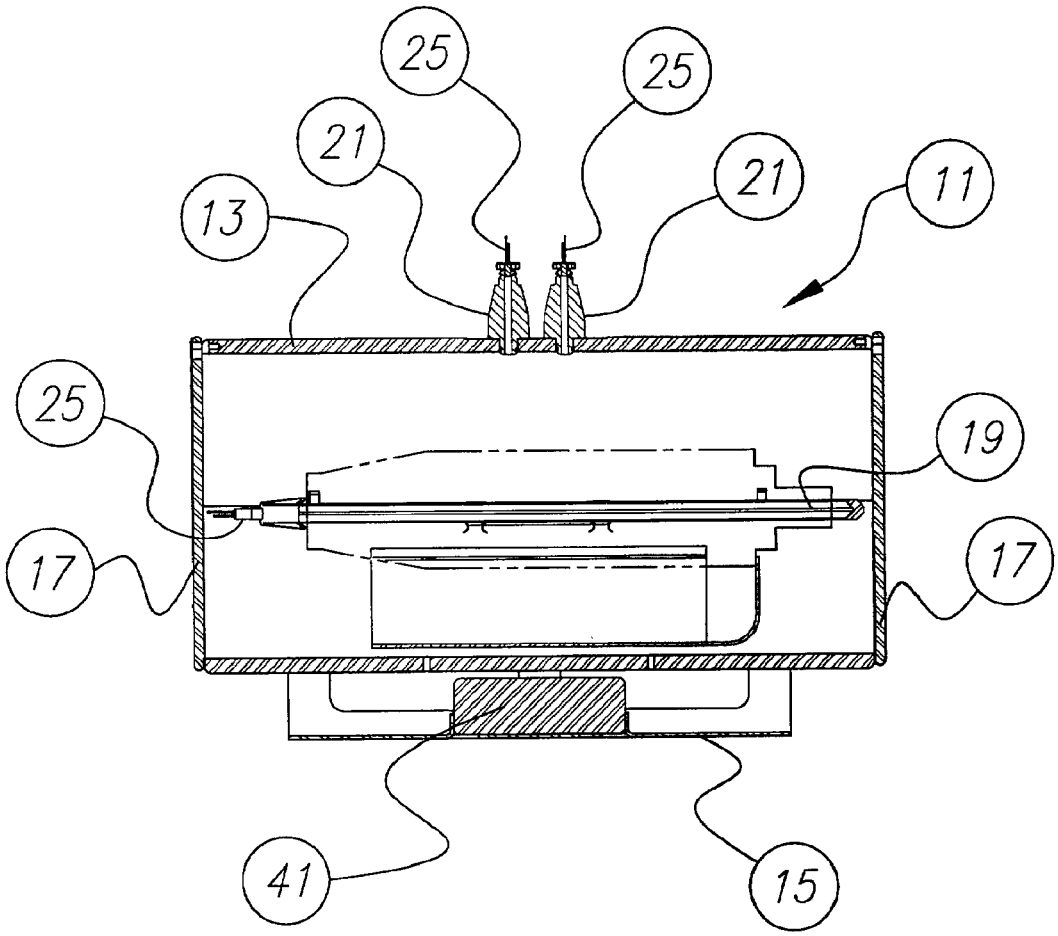
FIG. 7 shows a cross-sectional side view of the fragment suppression system of the present invention taken along line 7—7 of FIG. 6.
Figure 8:
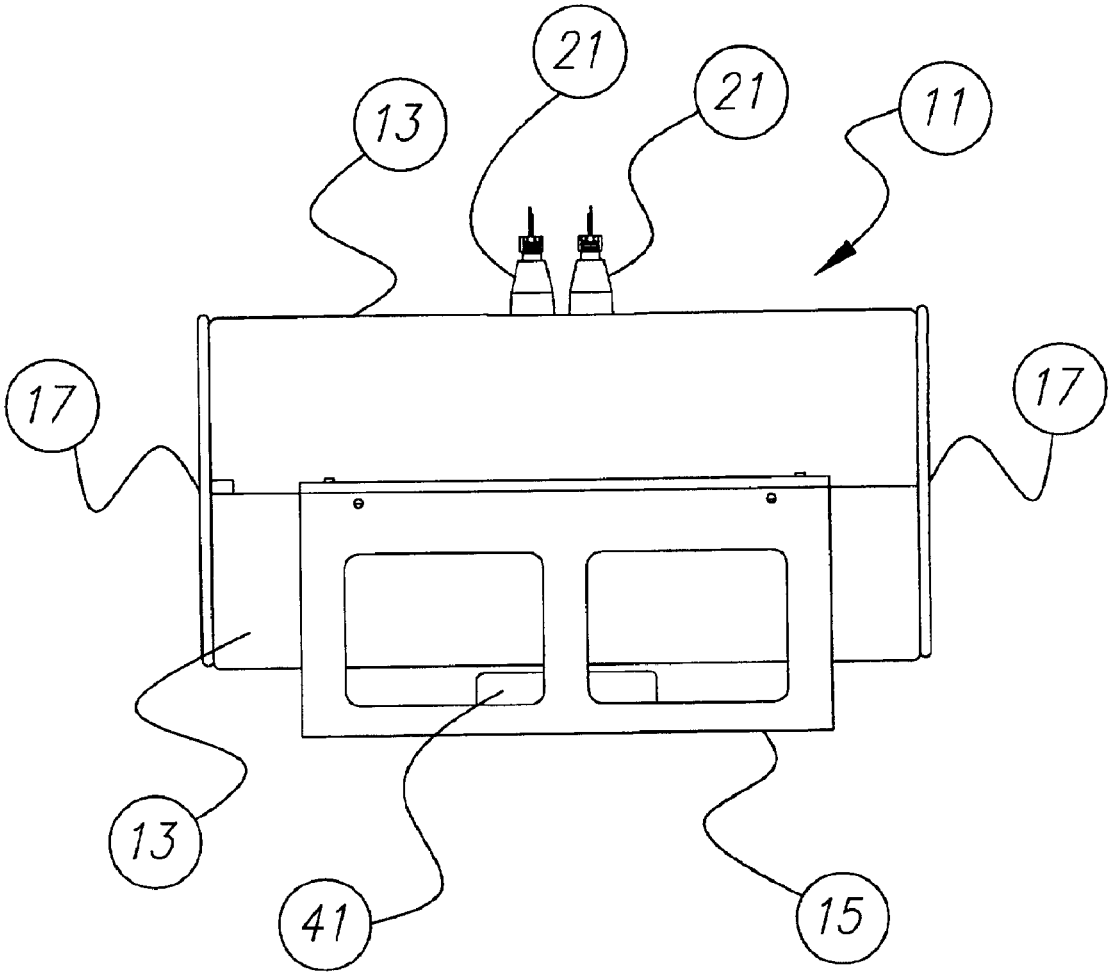
FIG. 8 is a side view of the fragment suppression system of the present invention.

Once the munition is positioned within the fragment suppression system 11, as shown in FIGS. 7 and 3, it is placed inside the vessel 12, which is then sealed by closing door 14. In a preferred embodiment, the inside of vessel door 14, as shown in FIG. 5 (with protector plate 39 not shown), includes electrical feed-throughs 24, for connecting to high-voltage exploding bridge wire detonators 25 (shown in FIG. 7), and spray nozzles 26 and drains 28. Near the center of the door 14 are the spray nozzles 26 for injecting the treatment chemicals into the vessel 12, and at the bottom are drains 28, preferably having sieves to prevent clogs while removing liquid effluent. In a preferred embodiment, there a four electrical feed-throughs 24 with terminal connectors providing a means for wiring detonators 25 within the vessel 12.

Once the munition is positioned in the fragment suppression system 11, within the vessel 12, the door 14 is sealed. At the same time, the contents of the munition must be exposed and the burster destroyed before the chemical fill can be treated. In a preferred embodiment, this is accomplished through use of a linear shaped charge 19 and conical shaped charges 21 as shown in FIG. 7. In practice, the linear shaped charge 19 and the conical shaped charges 21 are attached to the upper and lower sections of the fragment suppression system 11 before the munition is placed in the vessel 12. The detonators 25 are attached to the charges 19 and 21 and cables are connected to the detonators 25, strain relieved and electrically shorted for safety. The munition is positioned in the pre-assembled bottom section of the fragment suppression system 11. The pre-assembled top section of the fragment suppression system 11 is placed on top to complete the system, and the entire unit is positioned inside the vessel 12. The final fire system connections are made, the vessel door 14 is closed, strain relieved and then electrically shorted until the system is fired.

The use of shaped charges 19 and 21 to access the interior of the munitions is simple, safe, and repeatable. In a preferred embodiment, a single performed length of copper linear shaped charge 19 is used to open the main body of the munition. Of course, the shaped charges 19 and 21 may comprise copper, lead or any other suitable material well known to those of skill in the art. The linear shaped charge 19 is attached to the lower half of the fragment suppression 11 for ease of assembly and to maintain the proper standoff distance for an optimum cut. Experiments with three different munitions of interest have demonstrated that the linear charge 19 makes a complete cut in the munition, separating it into two pieces and exposing the chemicals contained therein. Detonators 25 are connected to the linear shaped charge 19 at each end for increased reliability.

In a preferred embodiment, two copper conical shaped charges 21 are used to break open the burster charge canister in the munition and detonate the burster explosives. The conical shaped charges 21 are positioned on the upper half of the fragment suppression system 11 above the case of the target munition providing a predetermined standoff distance. The conical shaped charges 21 are fired in the direction of the burster at approximately the same time as the linear shaped charge 19 is fired.

The conical shaped charge 21 is designed to impact the mutation's burster with sufficient energy to detonate the burster. The burster explosives can be any composition used by a variety of nations that have been involved in the manufacture of chemical weapons; however, they will likely be Tetryl, TNT or a combination of both. Of course, with recovered munitions the condition of the burster explosives is uncertain. It is not known whether the explosives were cast or pressed, at what density the material was manufactured, or what the effects of aging or contamination by the chemical fill may have on the detonation properties. All of these issues lead to uncertainty as to the detonation sensitivity of the burster explosives. However, the burster explosives do not need to be completely destroyed by the shaped charge 21 attack, as subsequent chemical treatment processes carried out in the vessel 12 will destroy residual explosives along with the chemical fill as long as the burster well is penetrated by the shaped charges 21. In any event, any remaining burster explosives will not be sensitized to shock or otherwise an explosive hazard.

In a preferred embodiment, the conical shaped charges 21 comprise a 32.2-gram, Composition A-3, multi-tapered copper conical shaped charge available, for example, from BAE Systems. For safety, exploding bridge-wire detonators 25 are used to initiate the shaped charges. These detonators are very insensitive to unexpected or undesirable energy inputs (static, impact, etc.). A high-energy firing system is required to initiate these detonators. Although this detonation system is preferred for safety reasons, the system could also be adapted to operate using standard blasting caps and a low voltage firing system which are well known to those of skill in the art.

A firing system initiates the linear shaped charge 19 to open the munition and the conical shaped charges 21 to penetrate the burster well. In a preferred embodiment, the firing system comprises a high-voltage capacitor discharge unit (CDU) capable of reliably firing four detonators 25 (1.5×40 mil exploding bridge wire) over cable lengths of up to 50 feet. The firing system consists of the CDU, a high voltage power supply, a control module, monitoring and diagnostic equipment, and safety controls. The CDU comprises a 1 micro-Farad ($\mu$F), 3 kV capacitor triggered from a 150-voltage module. A high-voltage power supply transforms 24 V DC to 3000 V and 150 V to power the CDU and trigger module, respectively. A control module makes the connection from the power, arm, and trigger signals to the appropriate modules. An operator can remove the entire firing system from the containment vessel 12 by using 50 foot detonator cables, and if desired, the operator can remove the control module an additional 200 feet from the firing system panel during operation.

The destruction of chemical-agent containing ordnance or munitions requires that the chemical-agent fills and energetics be converted to waste that can be safely handled and disposed of at commercial treatment and disposal facilities. In a preferred embodiment, the explosive destruction system 10 uses a low-pressure (<300 psi), low-temperature treatment method to transform chemical warfare fills to safe, less toxic species. This neutralization process relies on specific treatment chemicals which have been proven to be effective at detoxifying or neutralizing chemical warfare agents. The end products of the treatment reactions are mixtures of aqueous and/or combustible organic species that can safely be handled as commercial hazardous waste. In some cases, the chemical fills may require no treatment once the explosive hazard has been eliminated using the linear and conical shape charges.

Figure 9:
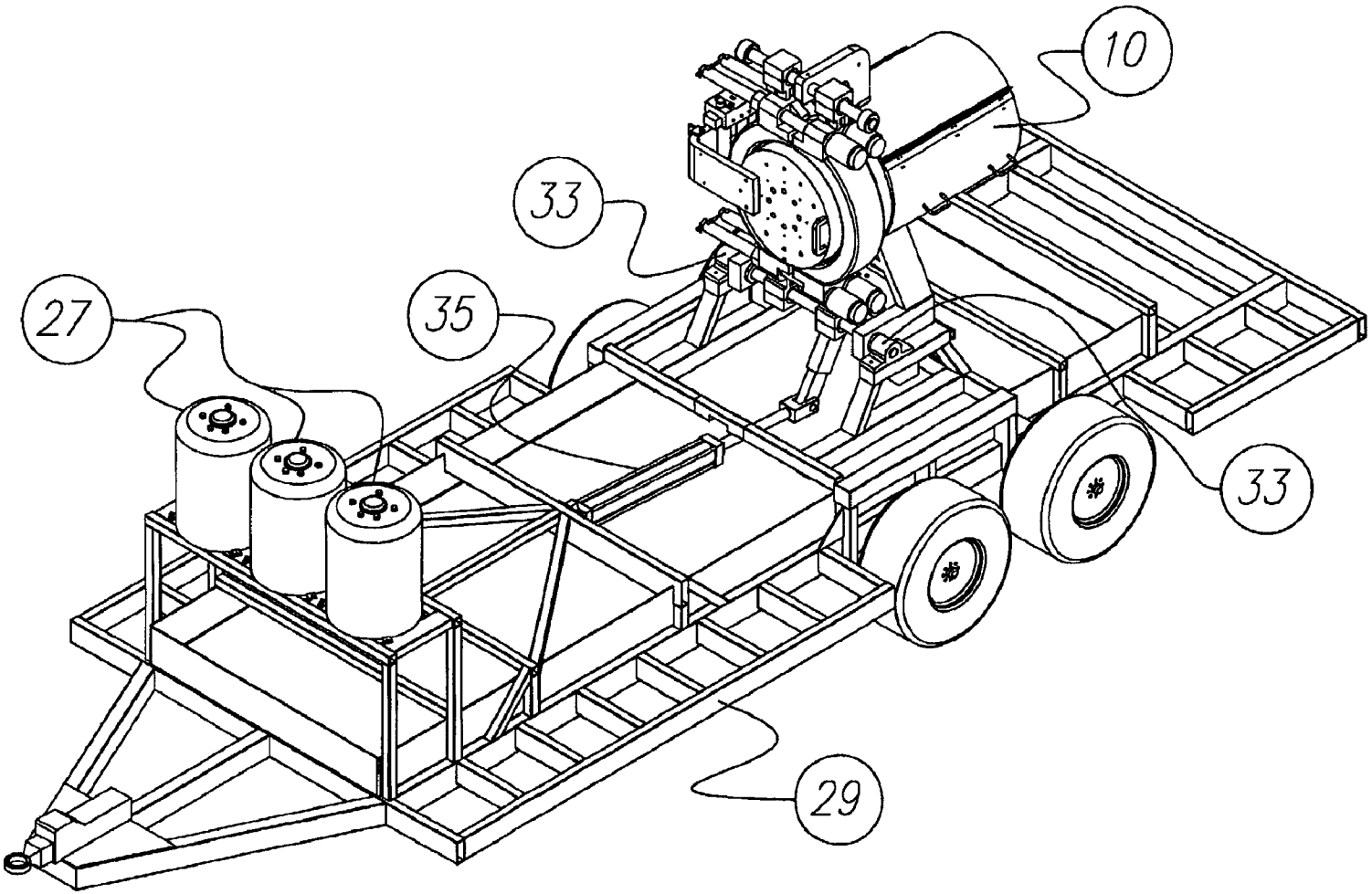
FIG. 9 is a perspective view of the trailer-mounted explosive destruction system of the present invention showing the embodiment having a hydraulically operated vessel agitation mechanism.
Figure 10:
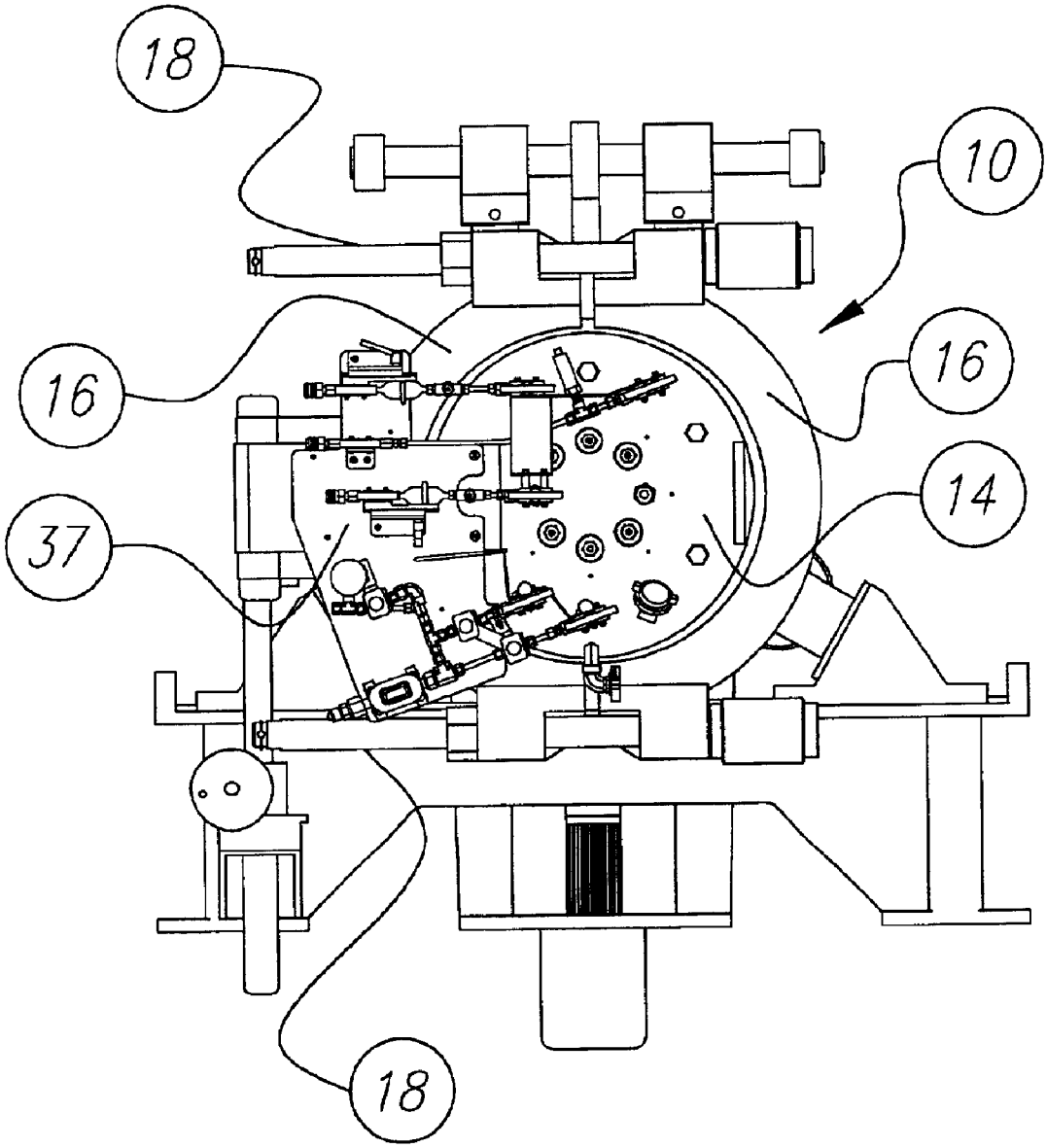
FIG. 10 is an end view of the explosive destruction system showing the closed door and valve manifold.

The treatment is carried out inside the containment vessel 12 after the munition has been opened by the linear shaped charge 19 and the conical shaped charges 21 so that there is no transfer of untreated chemical warfare fill. As shown in FIG. 9, treatment chemicals and water are stored in tanks 27 positioned on a trailer 29 on which the explosive destruction system 10 is mounted making the system easily transportable for rapid deployment in emergency situations. In one embodiment the treatment system comprises three 25-gallon, stainless steel tanks 27. The treatment chemicals contained in tanks 27 are pumped through piping into the containment vessel 12 through spray nozzles 26 located in the vessel door 14. In a preferred embodiment, the tanks 27 are heated to make viscous liquids easier to pump and to speed up the treatment process. As shown in FIG. 10, a valve manifold 37 on the vessel door 14 allows the operator to control the flow of chemicals, collect samples to confirm the treatment is complete, and drain the liquid effluent. Gaseous effluent resulting from the treatment process is vented through any appropriate air pollution control technology, such as, silica gel/ASZM-TEDA carbon filter.

Figure 13:
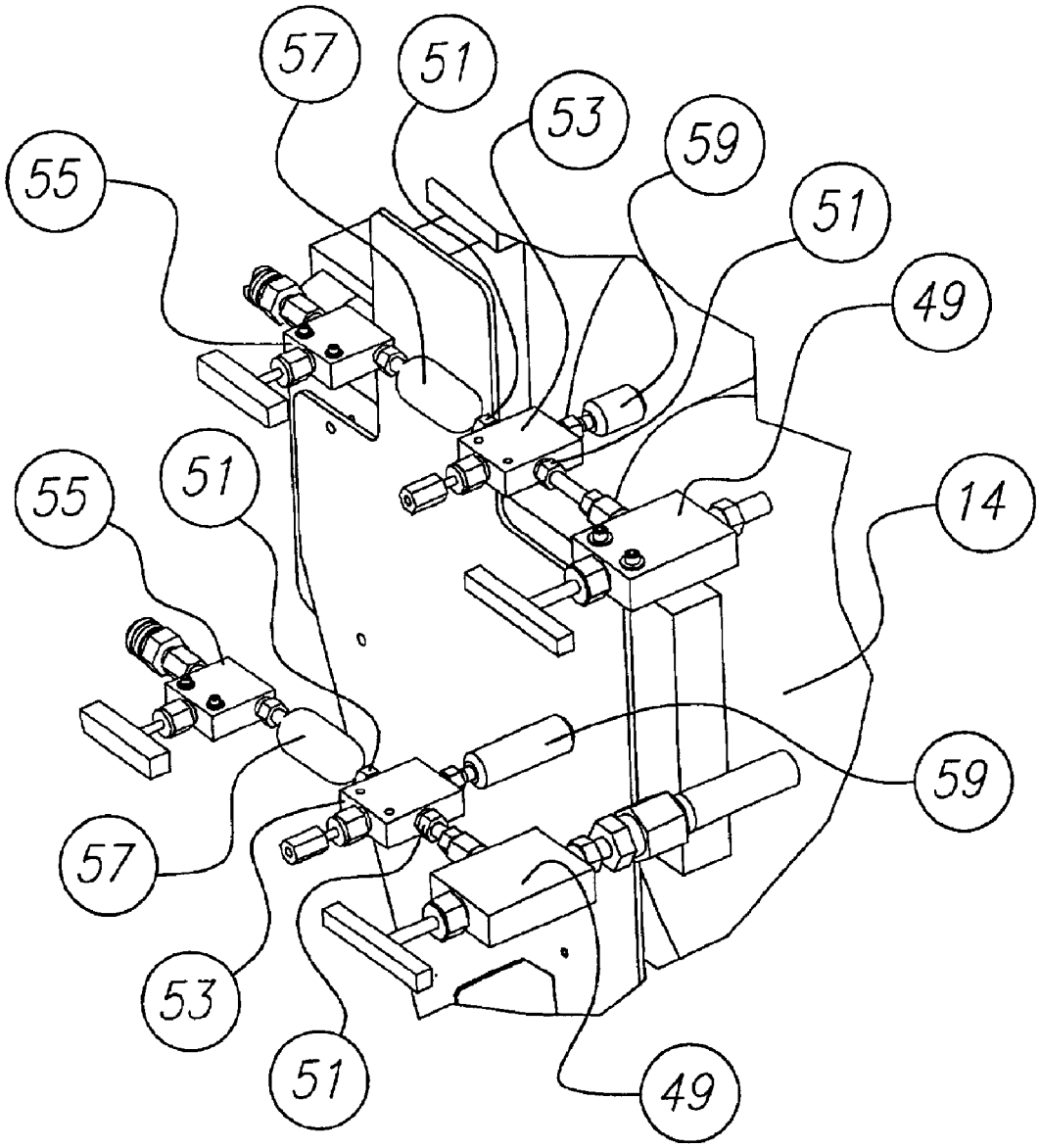
FIG. 13 shows two of the liquid and gas sample collection systems for the present invention.

The sample collection system comprises a system of tubing, valves, vacuum storage reservoir, and sample bottle or gasbag. As shown in FIG. 13, a plurality of sampling systems can be mounted on door 14. These systems comprise a first valve 49 positioned in-line between the tubing end inside the door 14 and a sample bottle 59 having its own valve 53. Couplers 51 are located on either side of valve 53. Following the bottle 59 and valve 53 is a vacuum reservoir 57, an additional valve 55 interposed between the vacuum reservoir 57 and a vacuum source or reagent or inert gas source. In order to sample liquid from inside the vessel door 14, valve 49 is closed to seal the contents of vessel 12, and valves 55 and 53 are opened to a vacuum source to evacuate the sample bottle 59 and vacuum storage reservoir 57. Valve 55 is then closed, and with sample valve 53 open, valve 49 is opened allowing liquid contained inside vessel 12 to flow into the sample holder 59. Sample bottle valve 53 is then closed to preserve the liquid sample in bottle 59, and reagents and inert gas are pumped through the tubing and vacuum storage reservoir 57 for decontamination purposes. Finally, with valve 49 closed, the couplings 51 are opened and the sample bottle 59 with valve 53 are removed for analysis and a clean bottle reinserted in-line. Collecting a gas sample is similar except that valves 55 and 53 are closed, a gasbag is installed in lieu of the bottle 59, and valve 49 is opened. Valve 53 is then slowly opened to inflate the gasbag with gas sample.

Table 1 provides a list of the chemical agents that can be treated by the explosive

TABLE 1

Chemical Fills That Can Be Treated In The EDS

| Symbol | Common Name | Chemical Name | Chemical Structure |
|---|---|---|---|
| BA | Bromacetone | Bromo-2-Propanone | $BrCH_2—CO—CH_3$ |
| CA | Bromobenzylcyanide | | $Br—C_6H_4—CH_2—CN$ |
| CG | Phosgene | Carbonyl dichloride | $Cl—CO—Cl$ |
| CK | Cyanogen Chloride | Chlorine Cyanide | $ClCN$ |
| CL | Chlorine | Chlorine | $Cl_2$ |
| CN | Chloroacetophenone | Chloromethyl-phenylketone | $Cl—CH_2—CO—C_6H_5$ |
| CNS | Mixture of CN, PS, and chloroform | | |
| CNB | Mixture of CN, benzene, and carbon tetrachloride | | |
| DA | Diphenylchlorarsine | Diphenyl-chlorarsine | $(C_6H_5)_2AsCl$ |
| H | Mustard | 2,2'-Dichloro-diethyl sulfide | $(Cl—CH_2—CH_2)_2—S$ |
| HS | Sulfur mustard | | |
| HD; HT | Distilled mustard; 60% mustard, 40% vesicant T | | |
| L | Lewisite | 1-Chloro-2-dichloro-arsinoethylene | $Cl—CH=CH—AsCl_2$ |
| NC | 80% PS, 20% $SnCl_4$ | | |
| PD | 50% CG, 50% DA | | |
| PG | 50% PS, 50% CG | | |
| PS | Chloropicrin | Nitrotri-chloromethane | $NO_2—CCl_3$ |
| GB | Sarin | Isopropyl methylphos-phonofluoridate | |
| VX | Nerve Agent | O-ethyl-S-(2-isopropyl-aminoethyl) methyl phos-phonothiolate | |

destruction system 10. This list is meant to be illustrative and is not comprehensive or otherwise limiting. Table 2 combines the different chemical agent fills into groups of chemicals having similar chemical reactivities. In accordance with Table 2, recovered chemical munitions can be grouped into four basic groups for chemical neutralization treatments.

TABLE 2

Chemical Groupings

| Chemical Group | Individual Chemical Fills |
|---|---|
| Organics | acrolein, bromoacetone (BA), bromobutanone (bromessigester), bromobenzyl cyanide (CA), chloroacetone, chloroacetophenone (CN), mustards (H, HD, HS, HT), chloroacetophenone/chloropicrin/chloroform (CNS), dichloroethylthiodiethylether (Vesicant T). |
| Chloride Family | phosgene (CG), chloropicrin (PS), $SnCl_4$/PS (NC), $SnCl_4$, $TiCl_4$ (FM), chloropicrin/phosgene (PG), cyanogen chloride (CK). |
| Organo-arsenics | lewisite (L), phosgene/diphenylchloroarsine (PD), diphenylchloroarsine (DA). |
| Oxidizer | chlorine ($Cl_2$) |

Several treatment chemicals can be used to neutralize the chemical agent fills as grouped in Table 2, including monoethanolamine (MEA), aqueous hydroxide, aqueous bisulfite, water, denatured alcohol, acetone, hydrogen peroxide, aqueous hypochlorite, and combinations thereof, among others. The U.S. Army is using MEA or MEA/NaOH for organics and organoarsenic groups from Table 2. Arsenic is a special hazard because of its persistent toxicity even after treatment of the original chemical agent. The organics often yield multiple species upon basic hydrolysis or aminolysis. These species may be hazardous wastes, but they will not have the handling or transportation restrictions associated with the highly toxic chemical agent starting materials. The Chloride group is preferably treated with aqueous hydroxide, while chlorine is treated with aqueous bisulfite. The chlorine reaction is spontaneous and limited only by the solubility of chlorine gas in the aqueous phase. In the absence of dissolved metals, the products of bisulfite treatment are nonhazardous.

All of the treatment reactions are exothermic. Some reactions, such as phosgene or chloroform with hydroxide, generate sufficient energy to be a concern in a batch process. However, the explosive destruction system's containment vessel 12 has a large thermal mass because of the thickness of the vessel's walls, so the heat of reaction will only aid in warming the vessel 12 and will not create dangerous overpressures.

In addition to the chemical agents, any residual explosives must be treated. The shaped charges used to access the munition include a linear shaped charge 19 to open the shell and at least one dedicated conical shaped charge 21 designed to pierce the burster at the same time as the shell is opened. This yields an extremely high probability of detonating the burster charge. Unfortunately, there is never a complete guarantee that the explosives will detonate because these munitions may have been buried for more than 50 years in uncontrolled conditions and may have undergone dramatic chemical and physical degradation. It is expected that the shaped-charge 21 will detonate, or at least ignite, the explosives. Traces of unreacted explosives (likely TNT or Tetyl) may remain after the initial detonation. Experiments have shown that solutions of TNT or Tetryl and individual chemical agents, when exposed to MEA, always treated the explosive as well as the chemical agent within one hour at 40° C. Actual reaction inside the explosive destruction system 10 may be slower because solubility limits the reaction rate. Aqueous hydroxide efficiently destroys nitrated aromatics only if the particles are small and the reaction is agitated. However, treatment of explosives in the EDS is meant only to clean up traces of explosives, not as a method of bulk explosive destruction.

The speed of neutralization treatment is limited by the solubility of the chemical warfare material in the treatment medium. If the agent has polymerized or degraded, the treatment may take longer. Inorganic chlorides may yield voluminous precipitates of oxides/hydroxides under these conditions, so agitation and excess treatment chemicals are required. In a preferred embodiment of the explosive destruction system 10, the chemicals are heated to near the boiling point and agitated, accelerating the reactions.

Figure 4:
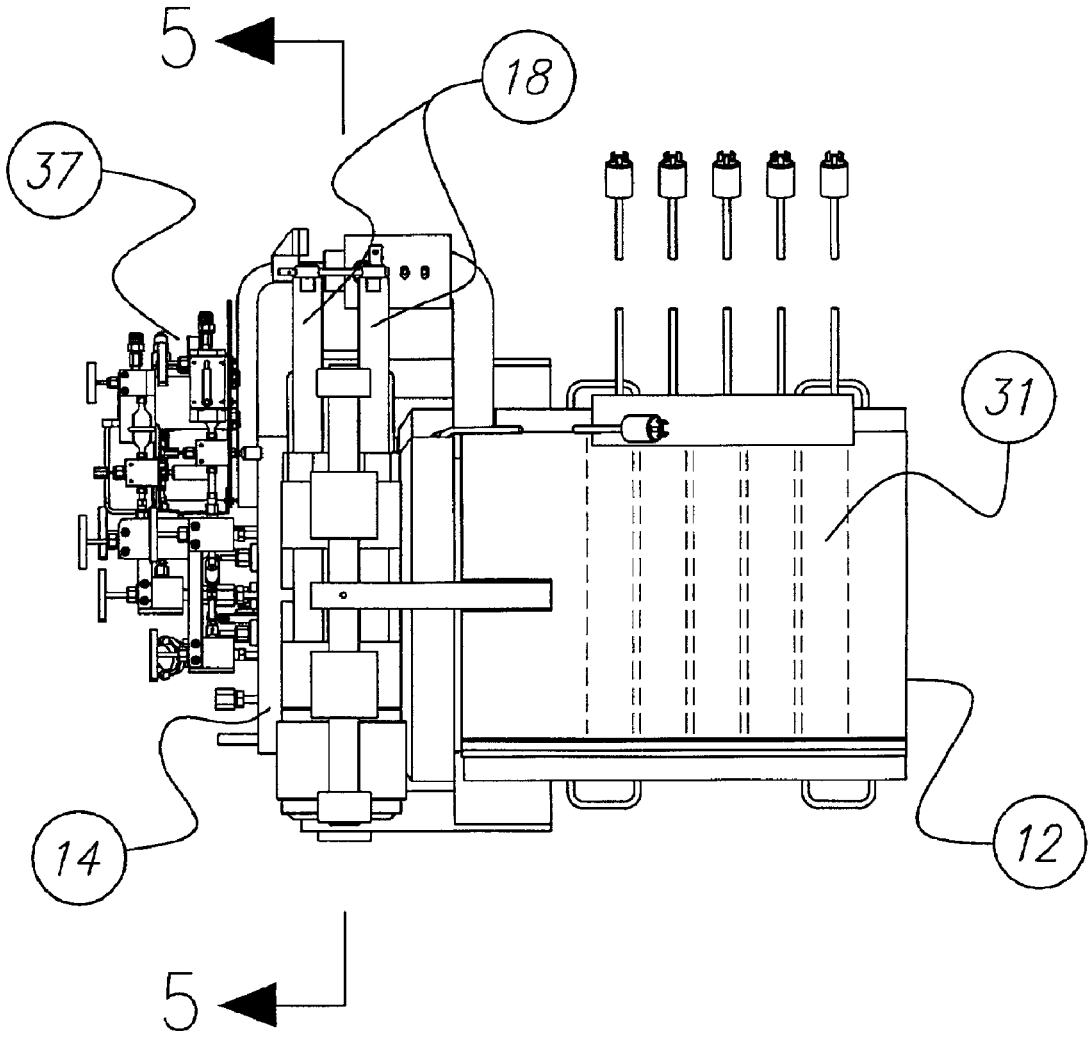
FIG. 4 is a side view of the explosive destruction system of the present invention.

Since any hardware inside the vessel 12 must withstand the explosive blast, the inventors have opted to both heat and agitate the vessel externally. As shown in FIG. 4, in a preferred embodiment the vessel 12 is heated with a plurality of 1-kW band heaters 31 using a feedback control system. Typically, it takes 3 to 4 hours to heat the contained fluids to 100° C. Fluid temperature can be controlled with ±4° C. The treatment chemicals can also be heated to about 60° C. in the tanks 27 before they are injected into the vessel 12.

Figure 11:
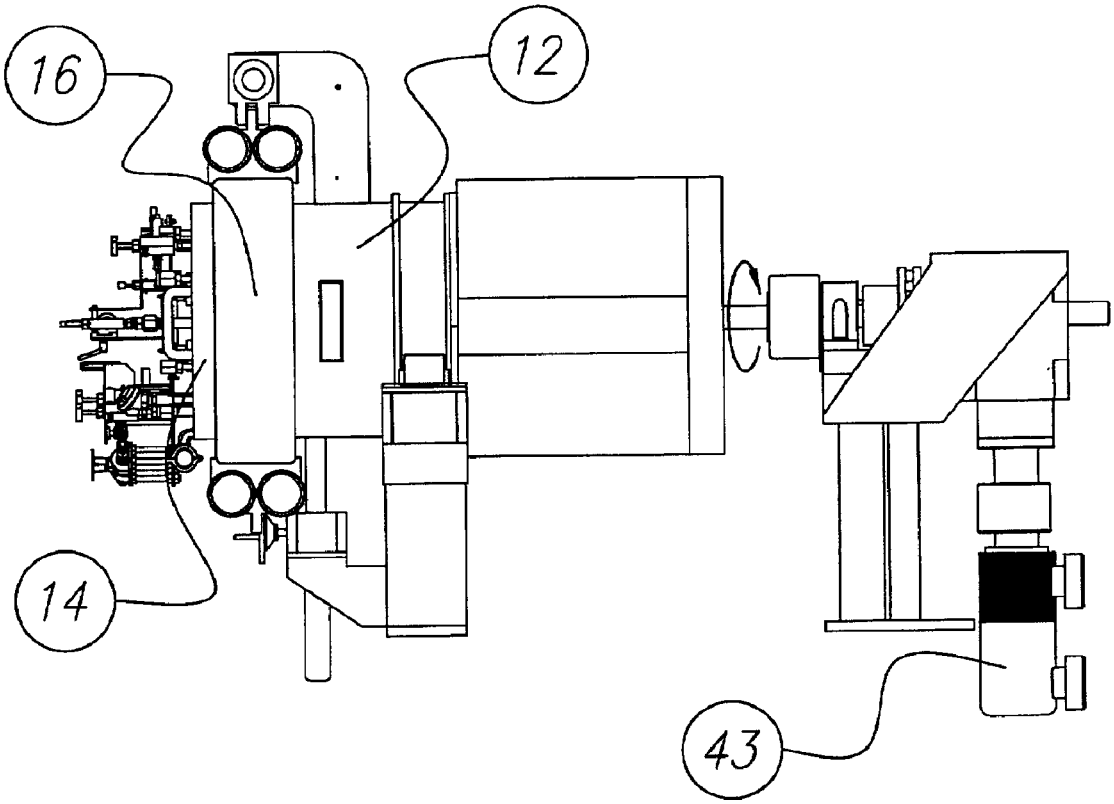
FIG. 11 is a side view of the explosive destruction system showing the embodiment having a motor-driven vessel agitation mechanism.
Figure 12:
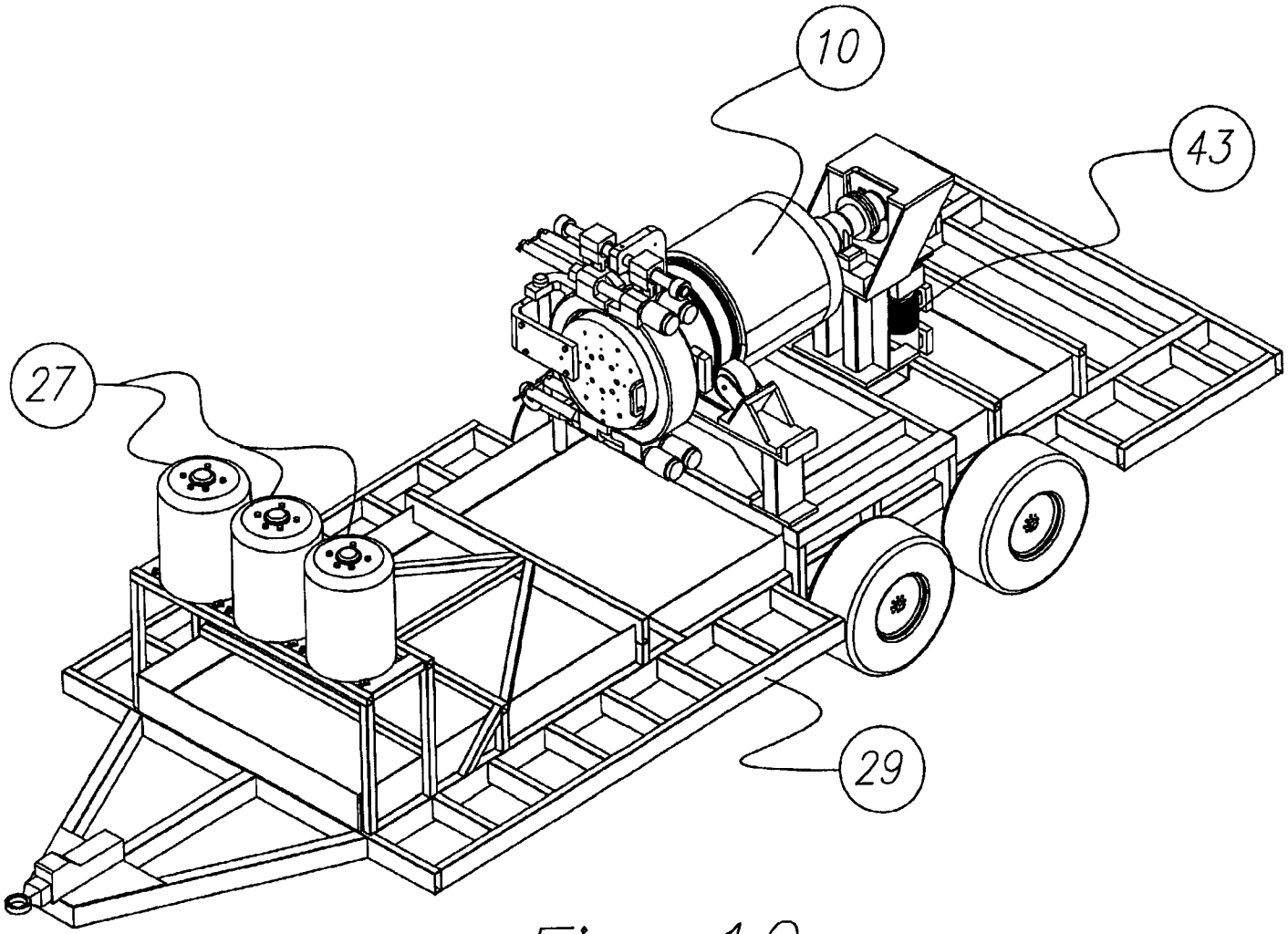
FIG. 12 is a perspective view of the trailer-mounted explosive destruction system of the present invention showing the embodiment having a motor-driven vessel agitation mechanism.

Referring again to FIG. 9, in the preferred embodiment the vessel 12 is also mounted on pillowblock bearings 33 allowing it to tilt forward and backward for agitating the contents of the vessel. A hydraulic system 35 is used to oscillate the vessel 12 between ±40 degrees from the horizontal position. Typically, the entire stroke through 80 degrees takes about 9 seconds. The vessel 12 can also be stopped in any position to aid in draining or sample collection. FIGS. 11 and 12 show an alternative embodiment in which the vessel 12 is rotated about its longitudinal axis by a motor 43. A motor-driven agitation system 43 has advantages in that no hydraulic mechanism is required to be located under the trailer 29 floor, thus simplifying the system and eliminating the potential for chemical damage or contamination of the hydraulic system 35.

A series of tests have been conducted to qualify and demonstrate the one-pound (TNT equivalent) explosive destruction system 10 as initially configured. Initial tests evaluated the chemistry, heating, chemical feed, and vessel agitation. The second set evaluated explosive containment.

In the first treatment test, the inventors treated methyl salicylate (oil of wintergreen) with MEA and NaOH. Oil of wintergreen has been used by the U.S. Army as a surrogate chemical fill and chemical agent simulant. It was useful in this test because it reacts with both the MEA and NaOH treatment chemicals to form two different products. All aspects of the explosive destruction system 10 worked as expected. The effluent was analyzed using both LCMS and NMR. The final concentration of oil of wintergreen was below the detection limit of 20 ppm.

In a second test, the inventors treated one pound of chlorine with sodium bisulfite. Chlorine is one of the fills that the explosive destruction system 10 is designed to destroy. The chlorine was generated inside the containment vessel 12 using a reaction of calcium hypochlorite and methane sulfonic acid. Again the system 10 worked as expected and the concentration of chlorine in the effluent was below the detection limit.

The initial explosive containment tests used bare charges of C4 explosive. FIG. 1 shows a charge and detonator assembled in the vessel. The first test used 170 grams of C4 (200 grams TNT equivalent), which matches the combined explosive load from the burster and the shaped charges for a 75 mm artillery test.

This was followed by a 25 percent over-test with 474 grams of C4 (1.25 pounds of TNT equivalent) to qualify the vessel for repeated use with one-pound TNT equivalent. Both tests were successful. Helium leak measurements before and after the detonations showed no change in the leak rate, or in some cases a decrease in the leak rate was observed, indicating that after detonation the seal 20 for the containment vessel 12 actually improved.

The shaped charges 19 and 21 and fragment suppression system 11 were then demonstrated on a series of tests with each of the three munition types. The special evaluation test hardware munitions for some of these tests were filled with borate to provide a non-hazardous surrogate for the chemical agent fill. The borate was neutralized with vinegar. The fragment suppression system 11 worked as designed. Visual inspection revealed no damage to the vessel 12 other than superficial scratches.

As an additional test of the entire explosive destruction system 10, a test was conducted with a phosgene filled bottle. The objective was to demonstrate the functionality of the chemical treatment system in concert with the explosive opening and firing system and the chemical sampling system on a combined chemical and explosive hazard. This test was the closest replica to the actual field use of the explosive destruction system and exercised all aspects of the system. A commercial lecture bottle containing one pound of phosgene gas was ruptured with linear shaped charges and the contents were treated with aqueous hydroxide. The system worked well during all these tests.

Finally, the explosive destruction system of the present invention has now been used to destroy actual field recovered chemical munitions. More specifically, seven 4-inch phosgene-filled Stokes mortars, seven 4.2-inch mustard-filled (blister agent) mortars, and five 4.5-inch mustard-filled projectiles have been successfully destroyed using the present invention. Furthermore, six M139 bomblets containing the nerve agent Sarin (GB) were destroyed using the present invention. In all of these destruction operations, the explosive destruction system of the present invention successfully: (1) contained the blast and overpressure during the detonation as verified by chemical agent air monitors; (2) cut open the mortars, projectiles, and bomblets using the linear shaped charge 19 as verified by post destruction inspection; (3) detonated the mortar, projectile, and bomblet explosive components (when present) as verified by post destruction inspection; (4) added reagent chemicals and chemically neutralized the chemical payload within the munition as verified by laboratory analysis; (5) agitated and heated the contents within the vessel 12 for the mustard and nerve agent mortars, projectiles, and bomblets to facilitate chemical treatment and neutralization; (6) drained the neutralized agent from the vessel 12 and used carbon filters to clean the vessel gases; and (7) continued to meet all helium leak-test requirements of the system 10.

Demonstrating a one-pound TNT equivalent explosive destruction system has proved the capability and advantages of the present invention. Of course, the present invention is also capable of treating larger explosively configured munitions, simply by enlarging the explosive containment structures. A 3.5-pound TNT equivalent system is presently being fabricated.

It should be clear to those of skill in the art that numerous modifications and variations of the present invention are possible in light of the above teachings. It is therefore to be understood that while the invention has been described in this specification with some particularity, it is not intended to limit the invention to the particular embodiments provided herein. On the contrary, it is intended to cover all alternatives, modifications, and equivalents as may be included within the spirit and scope of the invention as defined in the appended claims.

What is claimed is:

1. An apparatus for the destruction of explosively configured chemical munitions, comprising:

(a) an explosive containment vessel, said vessel having a sealable door, inlet means for electrical feed-through, inlet means for treatment chemicals, and outlet means for removing chemical effluent;

(b) a fragment suppression system contained within said explosive containment vessel, said fragment suppression system holding said munition within said vessel and mitigating high velocity fragments and absorbing shock upon detonation of said munition; and (b) means for explosively accessing the interior of said munitions when contained within said fragment suppression system.

2. The apparatus of claim 1, wherein said sealable door includes an all-metal seal, and said sealed vessel has a helium leak rate of less than about $1\times10^{-3}$ mbar-l/sec at a minimum pressure differential of 50 psi.

3. The apparatus of claim 2, wherein said seal maintains said leak rate before, during, and after detonation of said munition.

4. The apparatus of claim 1, further comprising a protector plate mounted to the interior of said door so that said electrical feed-through, said inlet means, and said outlet means are shielded from detonation fragments.

5. The apparatus of claim 1, wherein said vessel is capable of containing at least 500 individual detonations of about 1.0 pound of TNT.

6. The apparatus of claim 1, wherein said vessel is capable of containing at least 500 individual detonations of about 3.5 pounds of TNT.

7. The apparatus of claim 1, wherein said fragment suppression system comprises a hollow steel cylinder having end-plates so that said cylinder surrounds said munition, and includes means for supporting said cylinder within said vessel, said fragment suppression system being a sacrificial structure which absorbs fragment energy upon detonation of said munition.

8. The apparatus of claim 7, further comprising a stopper block positioned beneath said cylinder so that any shaped charge jet penetrating said munition and fragment suppression system is stopped without penetrating said stopper block.

9. The apparatus of claim 1, wherein said accessing means comprises at least one shaped charge positioned around said munition within said vessel.

10. The apparatus of claim 9, wherein said at least one shaped charge comprises a linear shaped charge to open the main body of the munition thereby exposing the munition contents.

11. The apparatus of claim 9, wherein said at least one shaped charge comprises a plurality of shaped charges positioned around said munition in said vessel.

12. The apparatus of claim 11, wherein said plurality of shaped charges comprises a linear shaped charge to open the main body of the munition, and at least one conical shaped charge to break open a burster section in said munition.

13. The apparatus of claim 9, wherein said shaped charges are electrically initiated using electrical power provided through said electrical feed-through inlet means.

14. The apparatus of claim 1, further comprising means for heating said vessel.

15. The apparatus of claim 14, wherein said heating means comprises a plurality of band heaters surrounding said vessel.

16. The apparatus of claim 14, wherein said heating means is capable of heating fluids within said vessel to about 100° C.

17. The apparatus of claim 1, further comprising a source of treatment chemicals connected to said inlet means for treatment chemicals.

18. The apparatus of claim 17, wherein said source of treatment chemicals comprises a plurality of supply tanks.

19. The apparatus of claim 18, wherein said supply tanks contain individual sources of treatment chemicals selected from the group consisting of aqueous hydroxide, water, denatured alcohol, acetone, mono-ethanolamine, aqueous bisulfite, hydrogen peroxide, aqueous hypochlorite, and dichloro-dimethylhydantoin.

20. The apparatus of claim 17, wherein said source of treatment chemicals is capable of heating said treatment chemicals.

21. The apparatus of claim 1, wherein said inlet means for treatment chemicals comprises at least one spray nozzle.

22. The apparatus of claim 1, further comprising means for agitating said vessel.

23. The apparatus of claim 22, wherein said means for agitating comprises an hydraulically driven oscillating mechanism.

24. The apparatus of claim 23, wherein said mechanism oscillates said vessel from about +40 degrees to −40 degrees from the horizontal position.

25. The apparatus of claim 22, wherein said means for agitating comprises a motor-driven mechanism rotating said vessel about its longitudinal axis.

26. The apparatus of claim 1, further comprising means for sampling the contents of said vessel.

27. The apparatus of claim 26, wherein said sampling means is capable of sampling both liquid and gas samples from the contents of said vessel.

28. The apparatus of claim 1, further comprising a trailer so that said vessel can be mounted on said trailer and made portable.

29. An apparatus for destroying explosively configured munitions, comprising:

(a) an explosive containment vessel, said vessel having a sealable door, inlet means for electrical feed-through, inlet means for treatment chemicals, and outlet means for removing chemical effluent;

(b) a fragment suppression system positioned within said explosive containment vessel, said fragment suppression system holding said munition within said vessel and mitigating high velocity fragments and absorbing shock upon detonation of said munition;

(c) at least one shaped charge positioned proximate said munition for explosively accessing the interior of said munition when contained within said fragment suppression system;

(d) means for heating said vessel;

(e) a source of treatment chemicals connected to said inlet means for treatment chemicals, and wherein said source of treatment chemicals is capable of heating said treatment chemicals;

(f) means for agitating the contents of said vessel; and (g) means for obtaining both liquid and gas samples from said vessel's contents.

30. The apparatus of claim 29, wherein said apparatus is mounted on a trailer so that said apparatus is made portable.

31. A method for destroying explosively configured chemical munitions, comprising the steps of:

(a) placing said munition within an explosive containment vessel, said vessel having a sealable door, inlet means for electrical feed-through, inlet means for treatment chemicals, outlet means for removing chemical effluent, and a fragment suppression system surrounding said munition, said fragment suppression system mitigating high velocity fragments and absorbing shock upon detonation of said munition;

(b) placing at least one shaped charge adjacent to said munition;

(c) sealing said vessel door;

(d) initiating said at least one shaped charge thereby cutting open said munition; and (e) introducing treatment chemicals into said vessel.

32. The method of claim 31, wherein step (d) comprises initiating said at least one shaped charge thereby cutting open and detonating said munition.

33. The method of claim 31, further comprising the step of heating said vessel while introducing said treatment chemicals.

34. The method of claim 33, further comprising the step of agitating said vessel after introducing said treatment chemicals.

* * * * *